US012703470B2

(12) United States Patent
Stach et al.

(10) Patent No.: US 12,703,470 B2
(45) Date of Patent: Aug. 11, 2026

(54) RETRACTABLE THRUSTER

(71) Applicant: RCM Trolling LLC, Clearwater, FL (US)

(72) Inventors: Robin Stach, Madeira Beach, FL (US); Christopher Stach, St. Petersburg, FL (US); Michael Schweiger, Clearwater, FL (US)

(73) Assignee: RCM Trolling LLC, Clearwater, FL (US)

( * ) Notice: Subject to any disclaimer, the term of this patent is extended or adjusted under 35 U.S.C. 154(b) by 0 days.

(21) Appl. No.: 19/362,832

(22) Filed: Oct. 20, 2025

(65) Prior Publication Data

US 2026/0109442 A1 Apr. 23, 2026

Related U.S. Application Data

(60) Provisional application No. 63/709,649, filed on Oct. 21, 2024.

(51) Int. Cl.

| | |
|---|---|
| ***B63H 20/02*** | (2006.01) |
| ***B63H 20/00*** | (2006.01) |
| ***B63H 20/32*** | (2006.01) |

(52) U.S. Cl.

CPC ..... *B63H 20/02* (2013.01); *B63H 20/007* (2013.01); *B63H 20/32* (2013.01)

(58) Field of Classification Search

CPC ..... B63H 20/02; B63H 20/007; B63H 20/32; B63H 2025/465

See application file for complete search history.

(56) References Cited

U.S. PATENT DOCUMENTS 5,836,794 A * 11/1998 Krueger ..... B63H 5/125 440/49

6,280,267 B1 * 8/2001 Griffith, Sr. ..... B63H 20/10 440/6

* cited by examiner

*Primary Examiner* — Andrew Polay

(74) *Attorney, Agent, or Firm* — Larson & Larson; Frank Liebenow

(57) ABSTRACT

The retractable bow thruster and trolling motor is a system designed for permanent installation into a boat hull. When not in use, the thruster retracts fully into the boat hull, with a plate or cowling sealing against a recess within the boat hull. This seal prevents water intrusion and avoids physical damage to the bow thruster from waterborne debris or shallow water conditions. When needed, the thruster extends outward from the bottom of the boat hull and is rotatable to provide thrust in any direction. In combination with an optional electronic control systems, the bow thruster will increase the maneuverability of the boat for docking or undocking, as well as maintaining position in the water.

15 Claims, 16 Drawing Sheets

RETRACTABLE THRUSTER

CROSS-REFERENCE TO RELATED APPLICATION

This application is a non-provisional application taking priority from U.S. Provisional Patent Application 63/709,649 filed Oct. 21, 2024, the disclosure of which is incorporated by reference.

FIELD OF THE INVENTION

This invention relates to the field of boat motors and more particularly to a motor with propeller that extends in and out of a boat hull to provide thrust and positioning.

BACKGROUND OF THE INVENTION

Trolling motors have long been utilized in the field of recreational and commercial fishing to provide precise boat control and positioning. These motors typically consist of a propeller, shaft, and motor housing mounted on either the bow or stern of a watercraft. Conventional trolling motors are designed to provide forward and reverse thrust, with directional control achieved through rotation of the entire motor assembly.

While effective for many applications, traditional trolling motor designs have limitations in maneuverability and efficiency. The need for improved control and versatility in various scenarios has led to ongoing innovations in trolling motor technology.

What is needed is an improved trolling motor that provides superior functionality and integration into a boat hull.

SUMMARY OF THE INVENTION

In one embodiment, a retractable trolling motor system for a boat is disclosed including a recess within a hull of the boat and a trolling motor assembly that has a trolling motor and propeller and is configured to fit within the recess when not in use and to extend outwardly from the recess when in use. A cowling is attached to a bottom portion of the trolling motor assembly and the cowling is shaped to seal against the recess when the trolling motor assembly is in a retracted position. There is a mechanism for extending and retracting the trolling motor assembly to and from the recess.

In another embodiment, a retractable trolling motor system for a boat, is disclosed including a recess within a hull of the boat and a trolling assembly affixed to a shaft and having a propeller. The trolling assembly is configured to fit within the recess when not in use and to extend outwardly from the recess when in use. A cowling is attached to an outside portion of the trolling assembly and the cowling is shaped to seal against the recess when the trolling assembly is in a retracted position. There is a device that extends and retracts the trolling assembly to and from the recess. In some such embodiments, a drive motor is rotatably interfaced to a first end of a second shaft, the second shaft housed within the shaft and the propeller is rotatably interfaced to a second end of the second shaft.

In another embodiment, a method of installing a retractable trolling motor to a boat is disclosed. The method includes cutting or forming an orifice in a surface of a hull of the boat and forming a cowling that is shaped to seal the orifice. A trolling motor and a propeller are provided and are affixed to an end of a shaft. The trolling motor and the propeller are configured to fit within the orifice when not in use and to extend outwardly from the orifice when in use. The cowling is affixed to the trolling motor. The shaft is rotatably affixed to the boat such that to the cowling, the trolling motor, and the propeller rotate when rotating the shaft when the trolling motor is extended.

The retractable bow thruster and trolling motor is a trolling motor and thruster system designed for permanent installation into a boat hull. When not in use, the thruster retracts fully into the boat hull, with a plate or cowling sealing against a recess within the boat hull. This seal prevents water intrusion and avoids physical damage to the bow thruster from waterborne debris or shallow water conditions. When needed, the thruster extends down below the bottom of the boat hull, where it can be rotated to provide thrust in any direction. In combination with electronic control systems, the bow thruster can increase the maneuverability of the boat for docking or undocking, as well as help the boat to maintain position in the water over a particular area or along a certain track. This is helpful for fishing but can also be used in other circumstances where automatic position control of the boat is important.

The upward and downward extension of the thruster can be controlled by a mechanical system, such as hydraulic piston, an air piston, a linear actuator, or a manual extension assembly. In some embodiments, rotational positioning of the thruster is by way of an electrical device such as a motor or actuator, allowing for automatic control, but in some embodiments, manual rotation is also anticipated. Manual control is preferably available at least as a backup in case of an electrical failure.

In some embodiments, the thruster is a directly-drive electric motor coupled to a propeller. In some embodiments it is anticipated that larger motor sizes may be prohibitively large to include within the body of the thruster and the motor is remotely located within the hull of the boat or above the deck of the boat, with a mechanical connection to transfer rotational energy from the motor to the propeller and, therefore, a larger and more powerful motor is possible. For example, a pancake motor is positioned around the shaft with its rotational motion carried down the shaft to the thruster via a splined connection between the motor and an axle within the shaft.

A section of the hull, the cowling, is placed beneath the thruster and fits like a puzzle piece into the hull itself. In order to ensure that when retracted the angular positions of the thruster and the cowling match for correct sealing, the rotational position of the thruster must be part of the control system. This position is monitored using an angular position sensor, or a switch, the switch only reaching its preferred open or closed position when the thruster cowling is aligned with the recess within the boat hull. In this manner, damage to the thruster or the hull is avoided that could result from retraction at a misaligned position.

When retracted, water will pass across the boat hull and across the cowling that protects the recess. To discourage water intrusion into the recess, in some embodiments, water diverting protrusions are placed on the hull just ahead of the cowling. The water diverting protrusions encourage the flow of water to pass around the cowling, at least across the position of the joint or seam between the cowling and the recess into the hull.

In some embodiments, secondary water diverting protrusions are placed at the aft of the cowling and having hollow centers. The flow of water passed the secondary water diverting protrusions creates a low pressure or venturi effect, lowering the pressure within the recess. This low pressure draws water out of the recess, draining water from around the thruster. By drawing out the water from around the thruster, water intrusion into the hull is reduced. In conditions of salty or other types of corrosive water, the life of the bow thruster is increased by being substantially dry while the vessel is in motion.

In the prior art, trolling motors are generally located at the bow or the stern rather than mid-ship. The disclosed system allows for placement of the thruster mid-ship or along the centerline of the hull rather than at the bow or the stern, as trolling motors were previously located. This reduces the rotational moment, or torque, experienced by the shaft during operation of the thruster. This reduction results from the shaft being supported at a position lower than the top of the hull, where a trolling motor would traditionally be supported. The reduction of torque results in reduced flexing of the shaft. Thus, a lighter shaft or shaft of reduced stiffness may be used, allowing for the use of less material or less-costly material.

Rotation of the thruster allows for control of the position of the vessel, specifically the position of the front of the hull. This can assist in both operations that require the boat to maintain a particular position or path in the water, as well as to complement the operation of the boat's primary drive system during operations such as docking or undocking.

In some embodiments of the invention, the thruster is built into a recess that is molded into a hull. This recess is designed/built in the hull for inclusion of the thruster. In alternative embodiments, the system is sold as a retrofit kit and installed in an orifice cut into the hull. In some embodiments, the shape of the recess is formed in a simplified shape such as the circle leading to a tube, for simpler insulation and more universal fit.

BRIEF DESCRIPTION OF DRAWINGS

The invention can be best understood by those having ordinary skill in the art by reference to the following detailed description when considered in conjunction with the accompanying drawings in which.

DETAILED DESCRIPTION OF THE INVENTION

Figure 1:
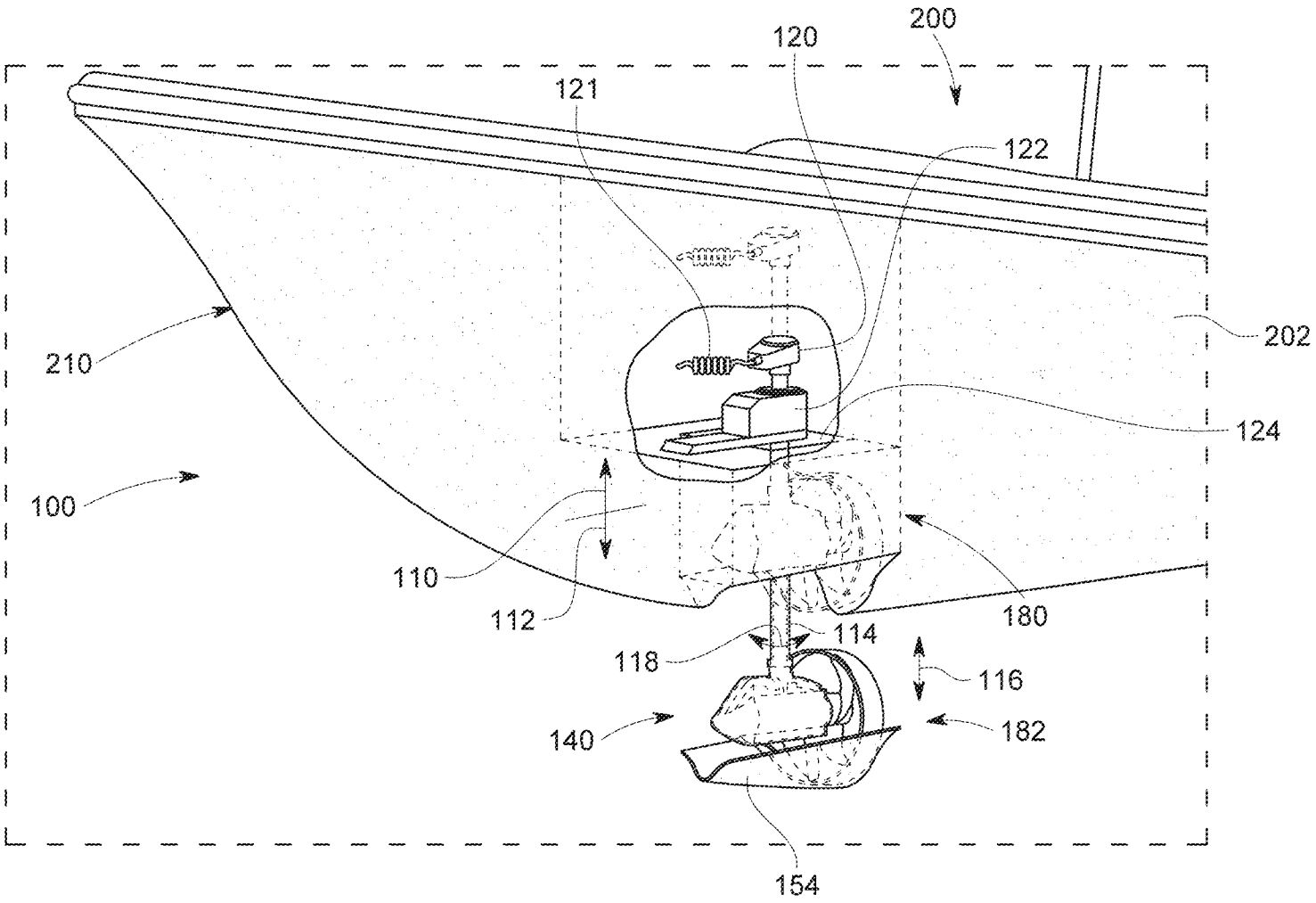
FIG. 1 illustrates an isometric partial cutaway view showing retracted and extended positions of the retractable bow thruster and trolling motor.

Reference will now be made in detail to the presently preferred embodiments of the invention, examples of which are illustrated in the accompanying drawings. Throughout the following detailed description, the same reference numerals refer to the same elements in all figures.

Figure 2:
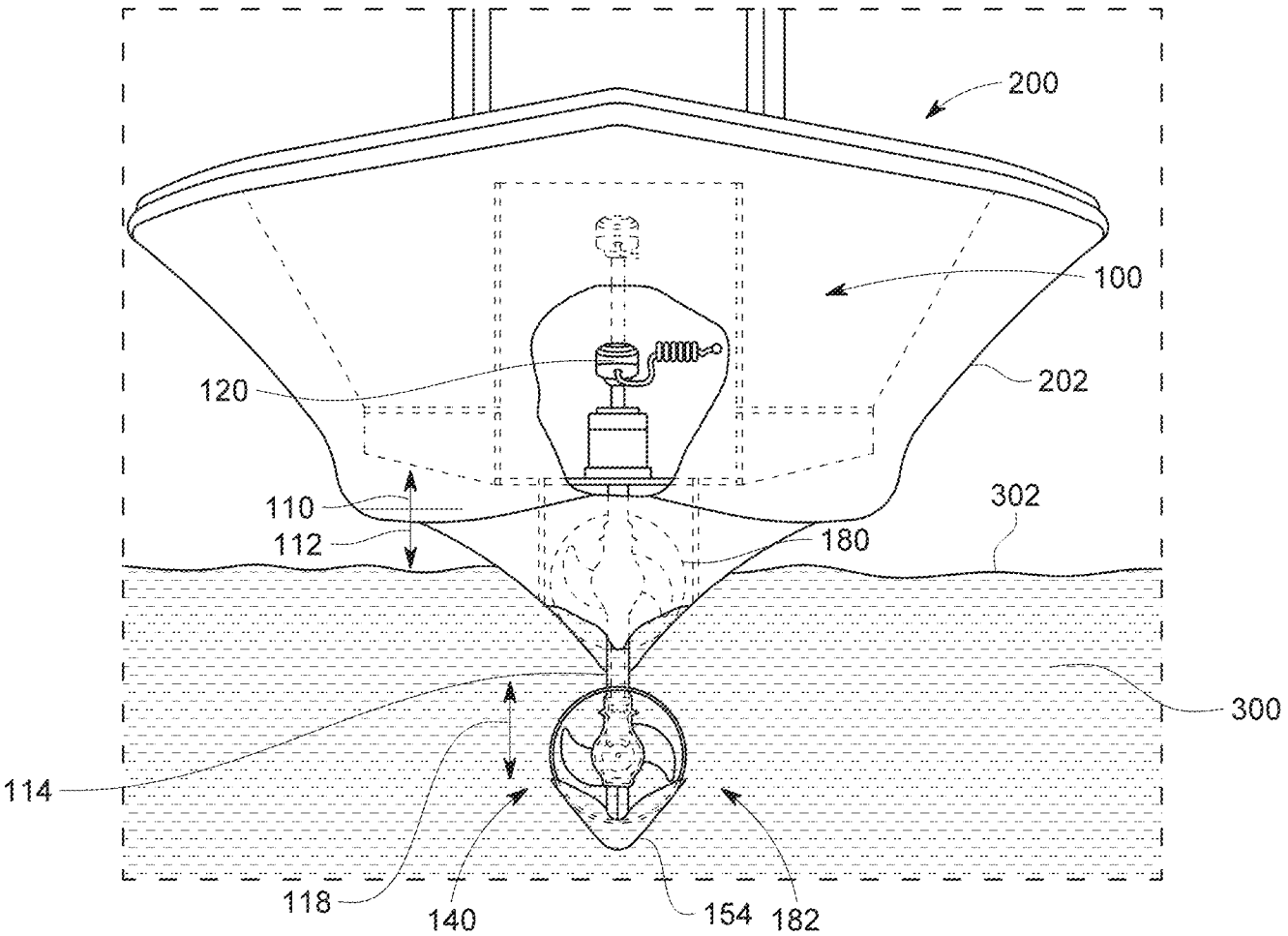
FIG. 2 illustrates a front partial cutaway view showing retracted and extended positions of the retractable bow thruster and trolling motor.
Figure 3:
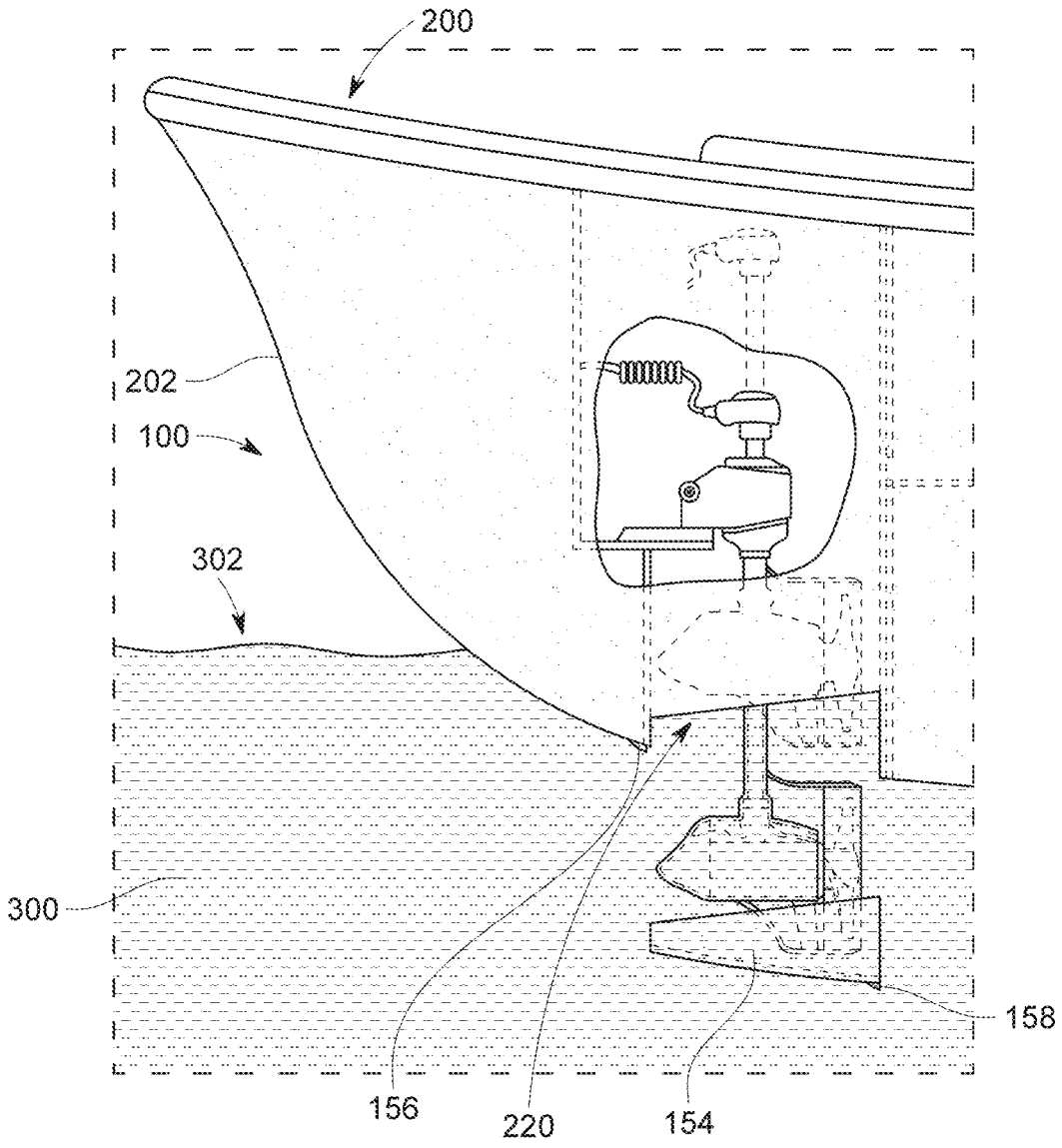
FIG. 3 illustrates a side partial cutaway view showing retracted and extended positions of the retractable bow thruster and trolling motor.

Referring to FIGS. 1-3, three partial cutaway views are shown with retracted and extended positions of the retractable bow thruster and trolling motor.

The retractable bow thruster and trolling motor 100 is shown with upper section 110 and lower section 112.

The upper section 110 includes the control box 120 connected to external signal and power supplies via the control and power cabling 121.

The positioning mechanism controller 122 interfaces with the shaft 114 to provide control of movement in the up/down movement direction 116 and control of movement in the rotational movement direction 118. The thruster 140 can be moved between the retracted position 180 and the extended position 182.

The positioning mechanism controller 122 can interface with the shaft 114 in a variety of ways, including splined connections, friction connections, or mechanical cabling.

The upper section 110 is braced with respect to the hull 202 of the boat 200 via the mounting plate 124. The mounting plate 124 is preferably permanently affixed to the interior of the hull 202. In the preferred embodiment, the hull 202 is molded anticipating integration of the retractable bow thruster and trolling motor 100. In alternative embodiments, the retractable bow thruster and trolling motor 100 is retrofitted into an existing hull 202 by cutting in a recess 220 and adding a mounting plate 124.

The thruster 140 includes a cowling 154 that extends and retracts with the thruster 140. The cowling 154 mates with the hull 202, covering the recess 220. This means that when the retractable bow thruster and trolling motor 100 is not in use, it is retracted into the hull 202 where it cannot be damaged.

When the boat is underway, and the thruster 140 is in the retracted position 180, the primary water-diverting protrusions 156 guide water across the seam between the hull 202 and the cowling 154, reducing water intrusion into the recess 220. Additionally, water that passes across the rear of the cowling 154 passes across the secondary water-diverting protrusions 158. The secondary water-diverting protrusions 158 include a hollow center, the passage of the water creating a low-pressure venturi effect, drawing any out water from within the recess 220 and the hull 202.

The boat 200 with bow 210 is shown in the water 300 with water surface 302.

Figure 4:
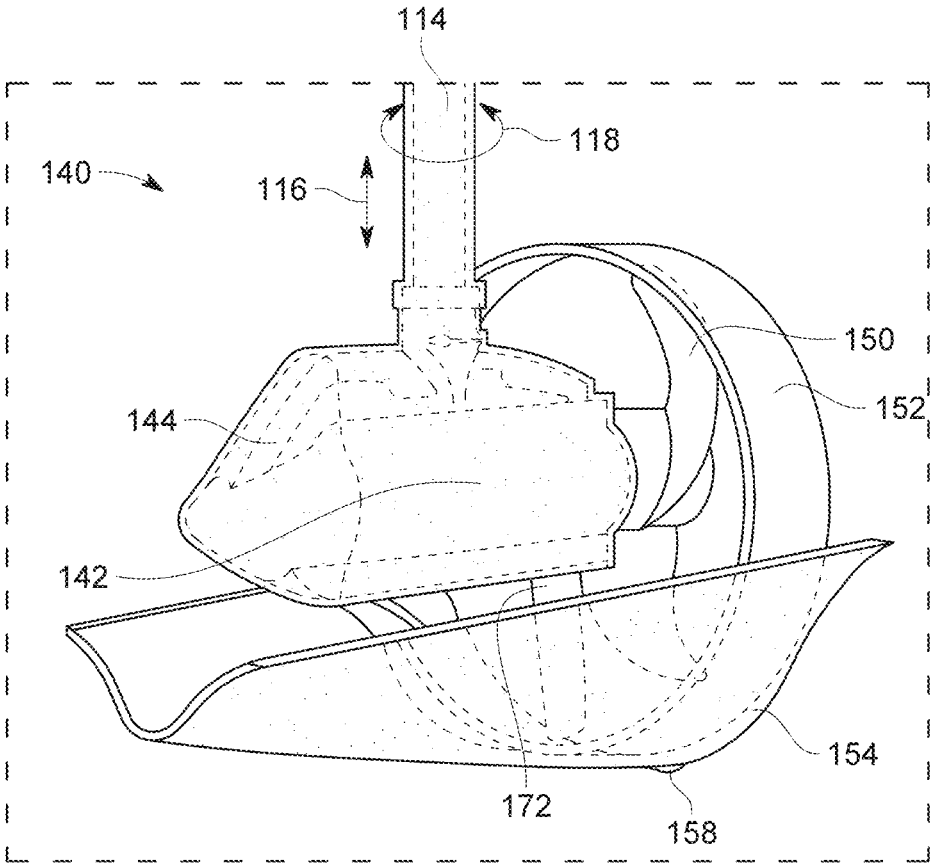
FIG. 4 illustrates a detail view of the thruster of the retractable bow thruster and trolling motor.

Referring to FIG. 4, a detailed view of the thruster of the retractable bow thruster and trolling motor is shown.

The thruster 140 is mechanically connected to the boat to 200 (see FIG. 1) via the shaft 114. The shaft 114 permits movement of the thruster 140 in the up/down movement direction 116 and movement in the rotational movement direction 118.

The thruster 140 includes motor housing 142 and a motor end bell 144. The prop 150 is within the prop casing 152, held in position by the prop casing lower support arm 172.

The secondary water-diverting protrusions 158 are shown, acting to draw water out of the recess 220 while the boat 200 (see FIG. 3) is underway.

Figure 5:
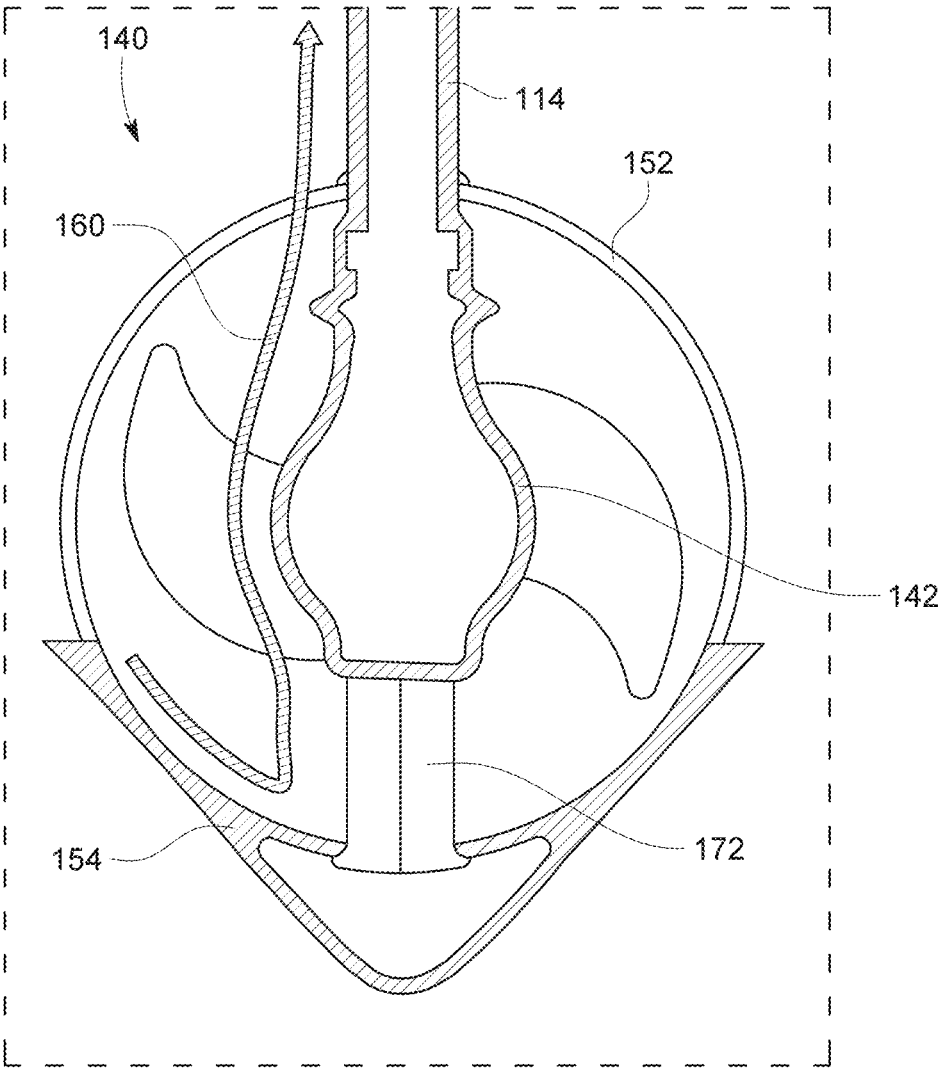
FIG. 5 illustrates a cutaway view showing load path of the retractable bow thruster and trolling motor.

Referring to FIG. 5, a cutaway view showing a load path of the retractable bow thruster and trolling motor is shown.

There are multiple loads there applied to the thruster 140 during use. Minor loads include the downward force of the weight of the thruster and the upward force of buoyancy. Major loads include resistance to passing through the water. This resistance includes a load against the cowling 154 that is placed at the lowermost end of the thruster 140. This load follows load path 160 from the cowling 154 through the prop casing lower support arm 172, through the motor housing 142, and up to the shaft 114.

Figure 6:
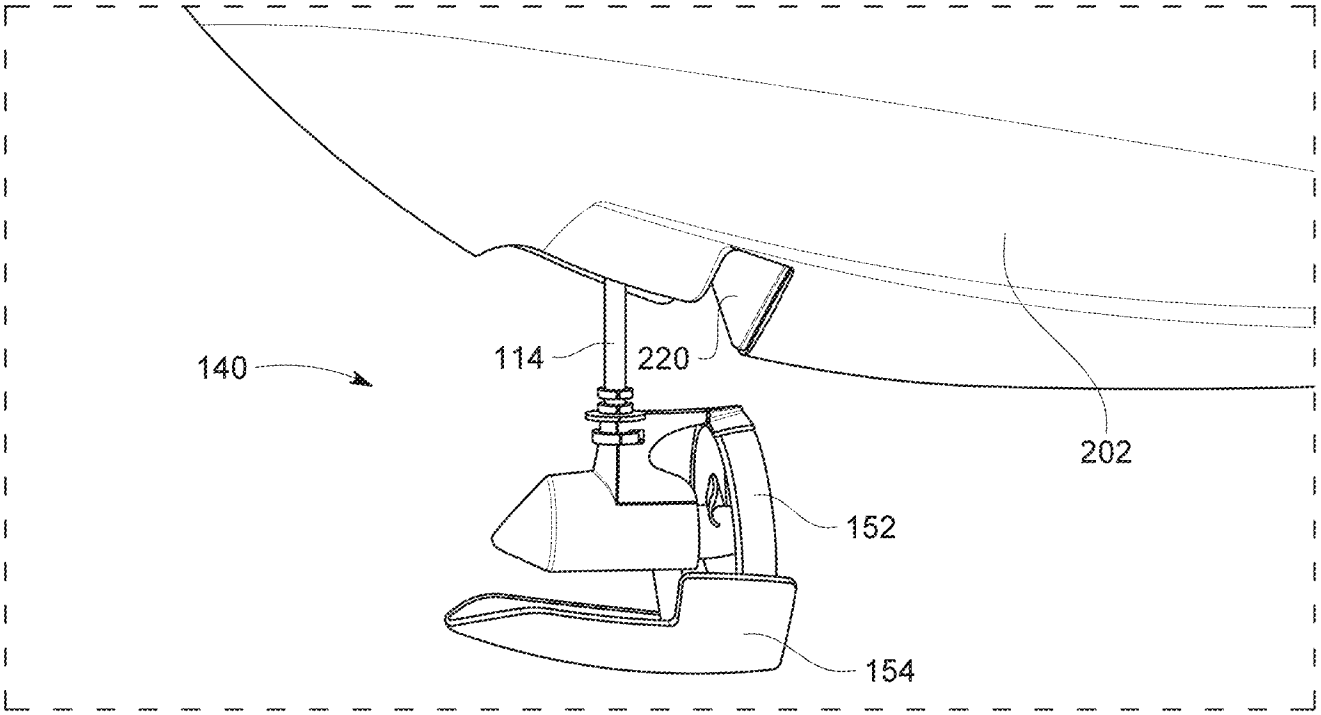
FIG. 6 illustrates first isometric showing extended position of thruster of the retractable bow thruster and trolling motor.
Figure 7:
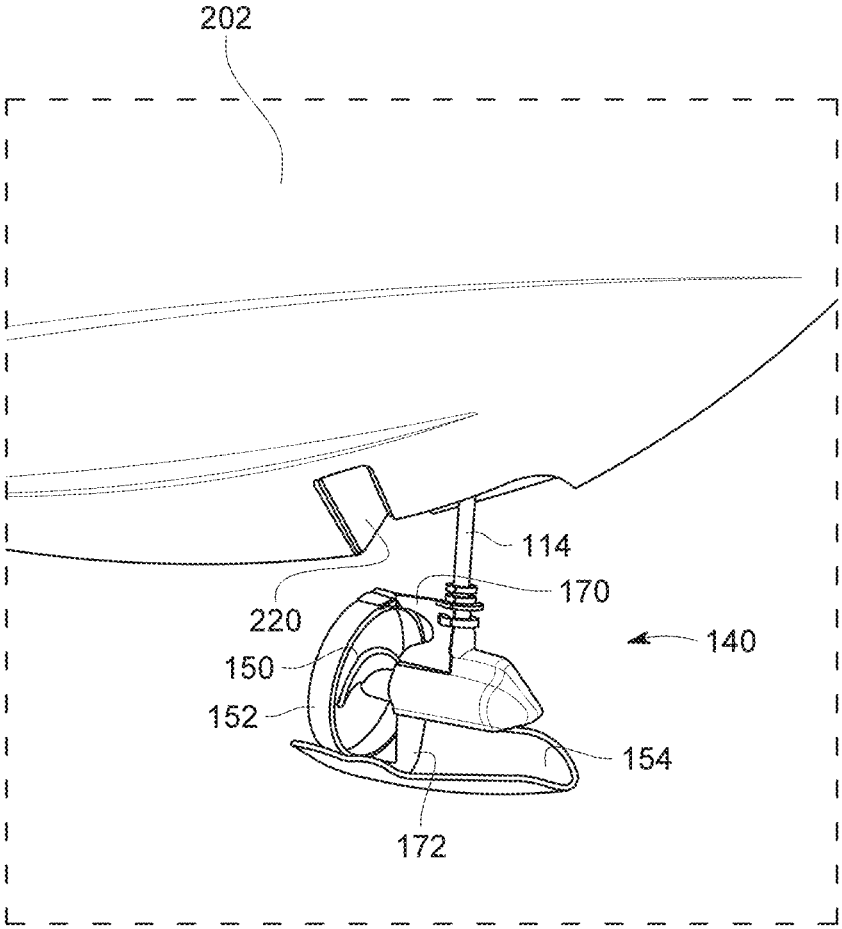
FIG. 7 illustrates a second isometric showing extended position of thruster of the retractable bow thruster and trolling motor.

Referring to FIGS. 6 and 7, first and second isometric views showing extended position of thruster of the retractable bow thruster and trolling motor are shown.

The thruster 140 is shown extending beyond the hull 202, the shaft 114 protruding through the recess 220.

The prop casing 152 around the prop 150 is supported by the prop casing upper support arm 170 and the prop casing lower support arm 172.

The cowling 154 is affixed to the prop casing lower support arm 172 and the prop casing 152. When the thruster 140 is retracted, the cowling 154 covers the recess 220.

Figure 8:
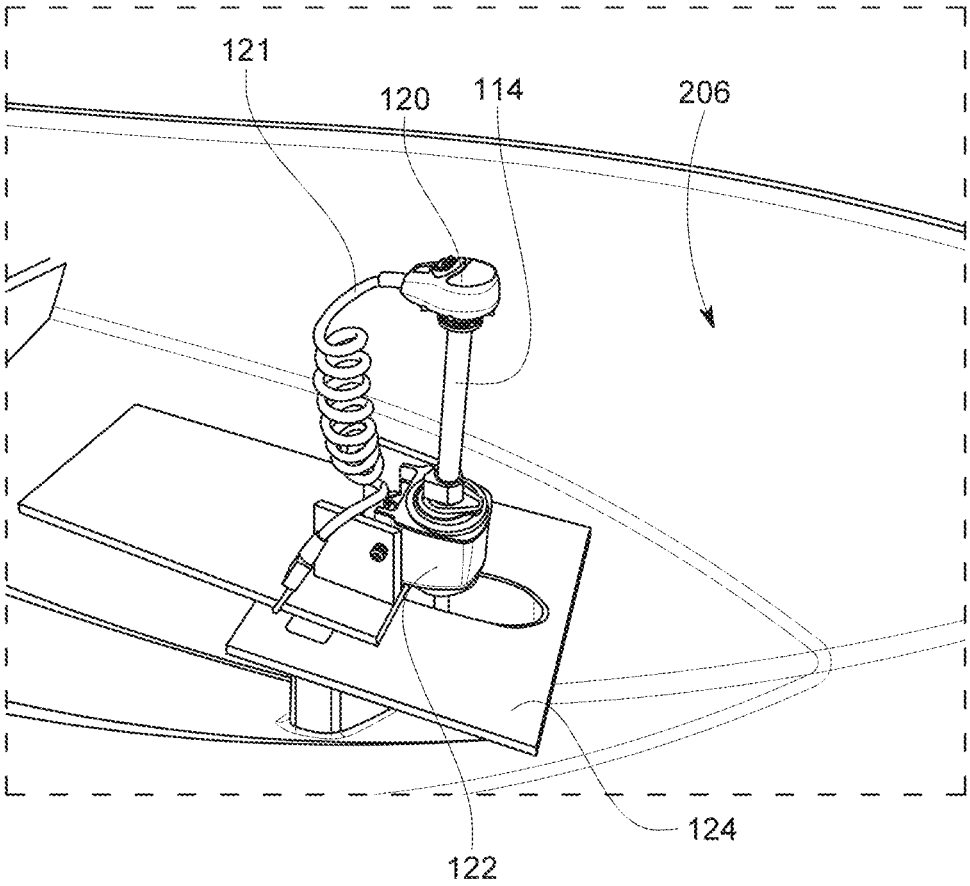
FIG. 8 illustrates a first isometric showing view from inside the hull of the retractable bow thruster and trolling motor.

Referring to FIG. 8, a first isometric showing view from inside the hull of the retractable bow thruster and trolling motor is shown.

The control box 120 is shown affixed to the shaft 114, the control box 120 receiving power and signal information via the control and power cabling 121. The positioning mechanism controller 122 is affixed to the mounting plate 124, which is in turn connected to the hull interior 206.

Figure 9:
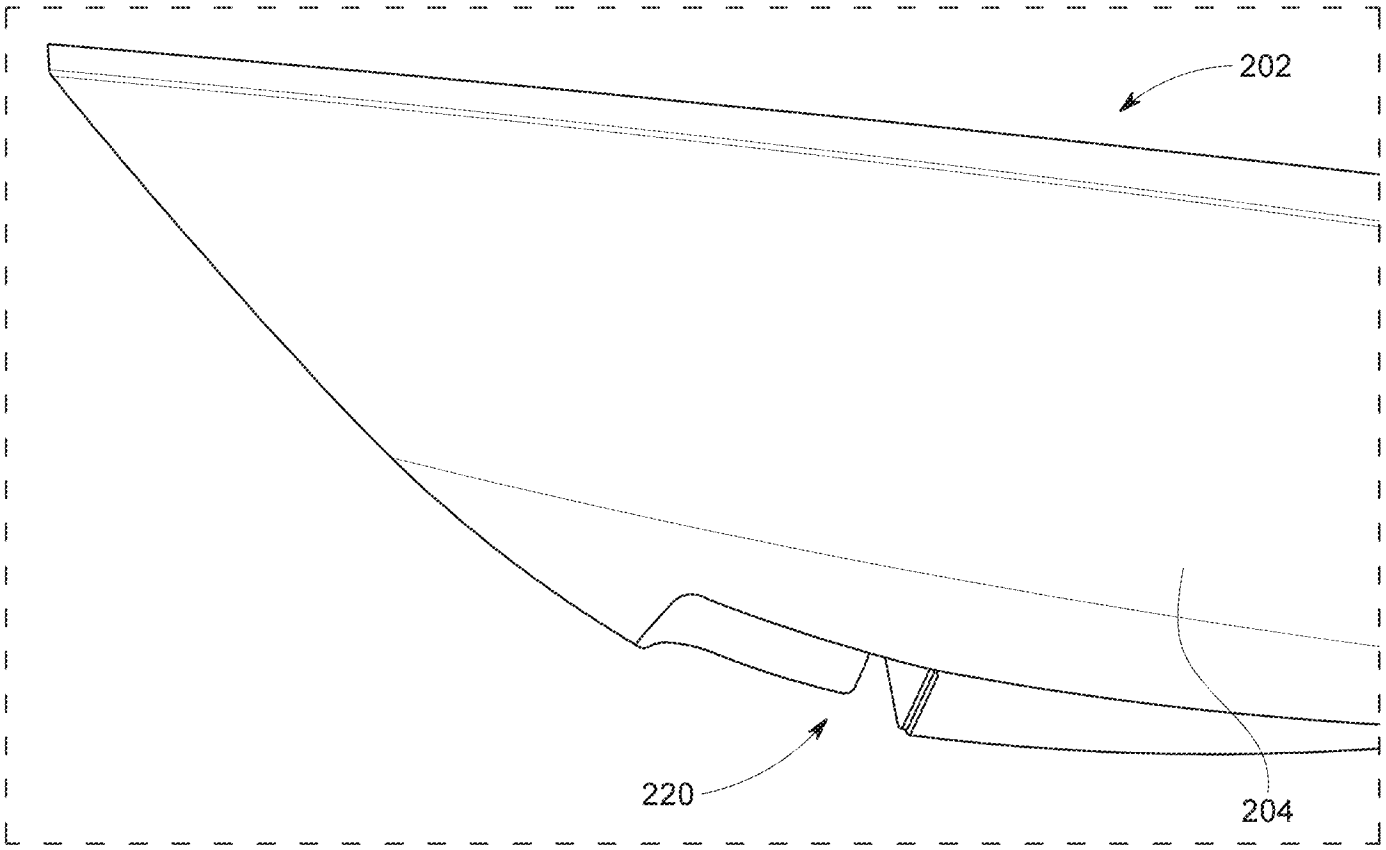
FIG. 9 illustrates a side view with thruster removed showing recess of the retractable bow thruster and trolling motor.

Referring to FIG. 9, a side view with thruster removed showing recess of the retractable bow thruster and trolling motor is shown.

The hull exterior 204 of the hull 202 is shown with recess 220.

Figure 10:
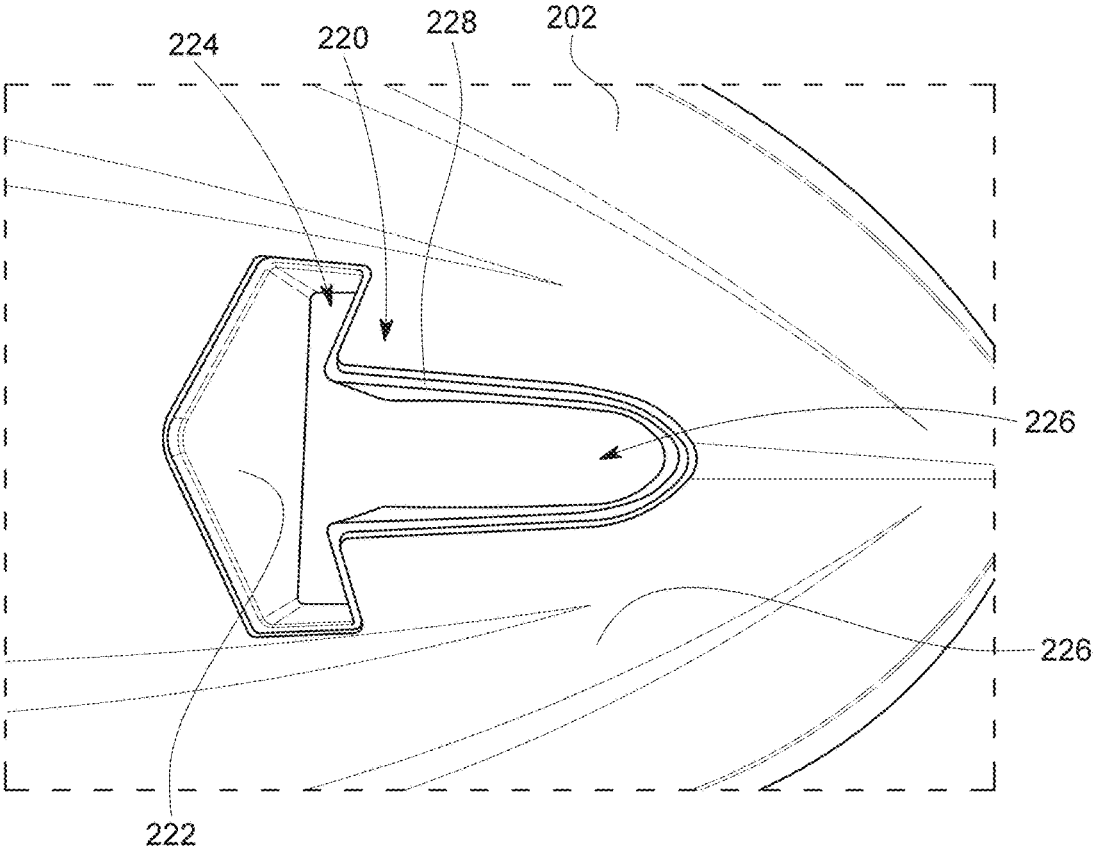
FIG. 10 illustrates a bottom view with thruster removed showing recess of the retractable bow thruster and trolling motor.

Referring to FIG. 10, bottom view with thruster removed showing the recess.

The recess 220 is shown passing through the hull 202, the recess 220 including recess interior walls 222 and the perimeter lip 228 against which the cowling 154 (see FIG. 7) seals when the thruster 140 (see FIG. 1) is in the retracted position.

In this embodiment the recess 220 is substantially T-shaped, with a first channel 224 intersecting a second channel 226 at a 90° angle. The first channel 224 allows passage of the prop casing 152 (see FIG. 7) during retraction, and the second channel 226 permits passage of the motor housing 142 (see FIG. 7).

Figure 11:
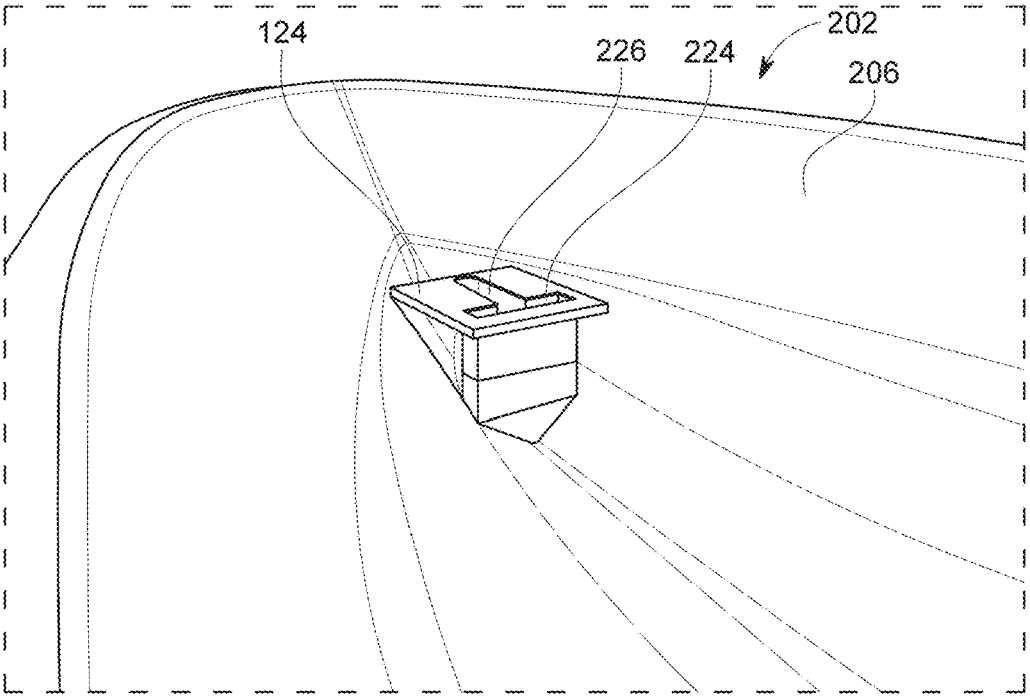
FIG. 11 illustrates an interior view with thruster removed showing recess of the retractable bow thruster and trolling motor.

Referring to FIG. 11, interior view with thruster removed showing a recess of the retractable bow thruster and trolling motor is shown.

The recess interior walls 222 are visible, including the first channel 224 and the second channel 226. The mounting plate 124 is visible, as is the hull interior 206 of the hull 202.

Figure 12:
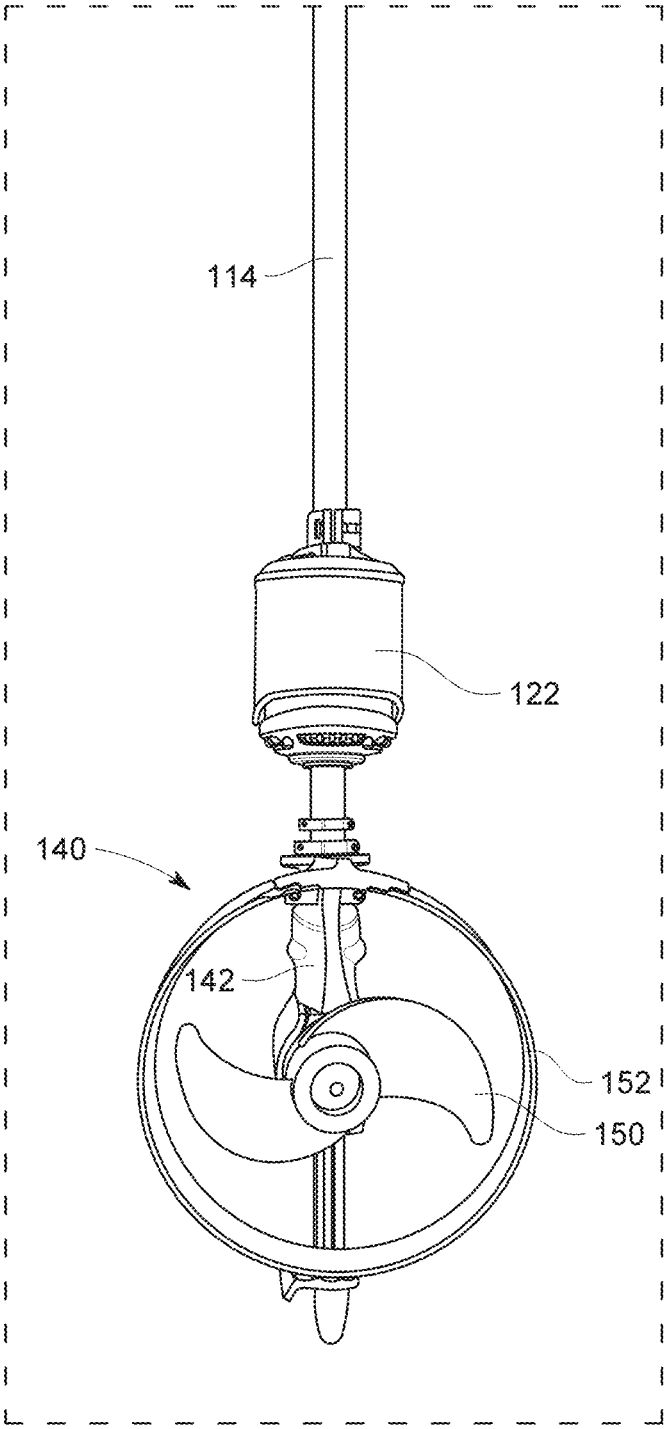
FIG. 12 illustrates a rear view of assembly removed from hull of the retractable bow thruster and trolling motor.
Figure 13:
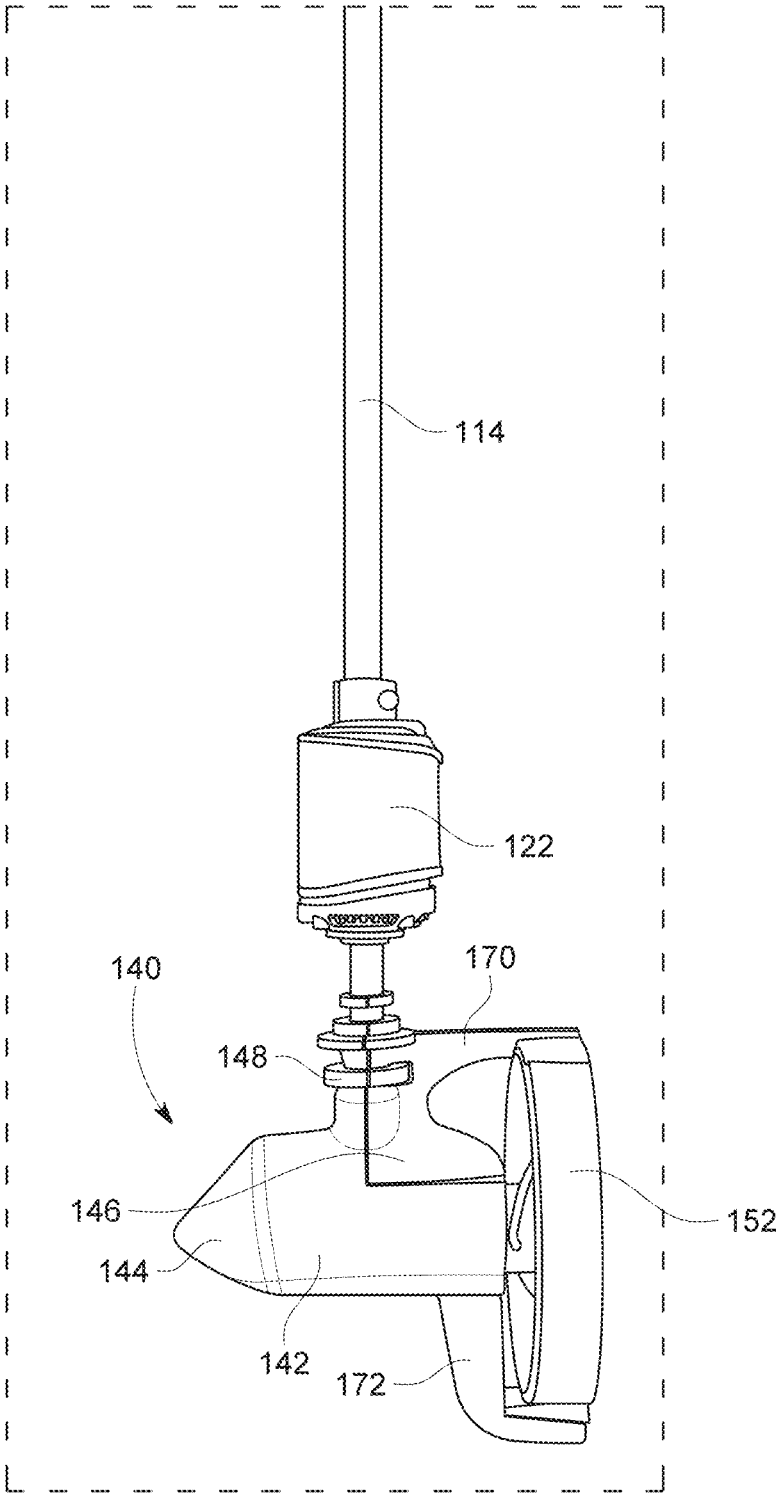
FIG. 13 illustrates a side view of assembly removed from hull of the retractable bow thruster and trolling motor.
Figure 14:
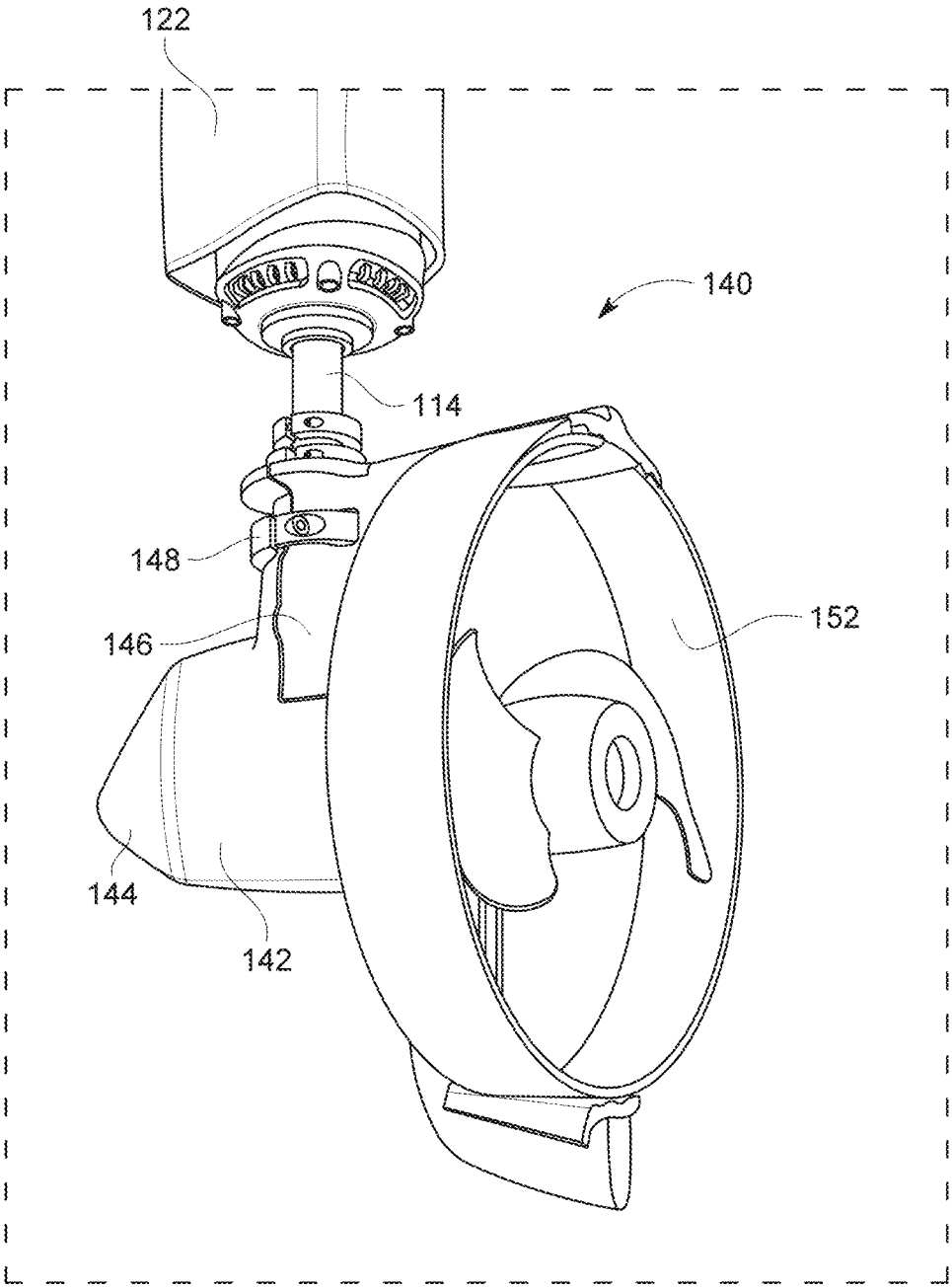
FIG. 14 illustrates a first isometric view of assembly removed from hull of the retractable bow thruster and trolling motor.

Referring to FIG. 12-14, a rear view, side view, and first isometric view of the assembly removed from hull of the retractable bow thruster and trolling motor is shown.

The shaft 114 is shown passing through the positioning mechanism controller 122. The thruster 140 includes the motor housing 142, and prop 150 within the prop casing 152. The prop casing 152 is supported with respect to the motor housing 142 and motor end bell 144 by the shaft 114 by the prop casing upper support arm 170 and the prop casing lower support arm 172.

Optionally included is the motor housing access hatch 146 held in position by the collar clamp 148. Removal of the motor housing access hatch 146 allows access to the electronics and permits removal of the motor housing 142 with motor end bell 144 for motor maintenance or replacement.

Figure 15:
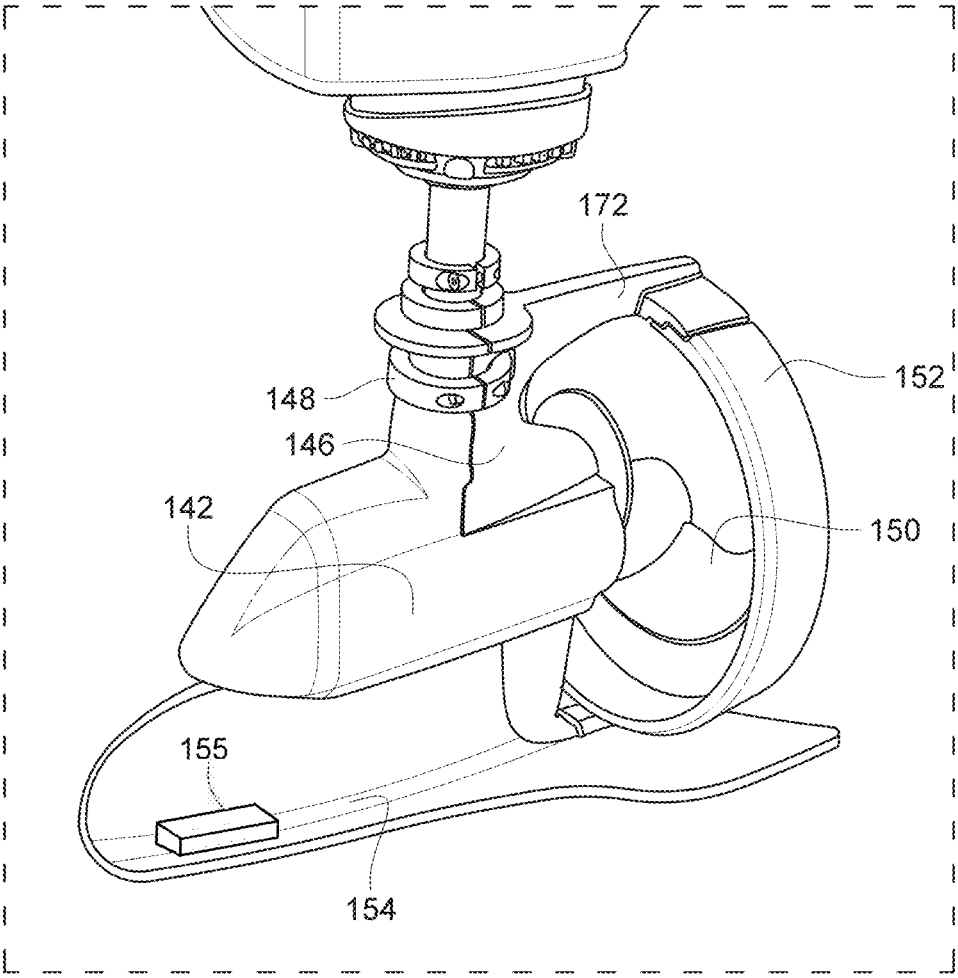
FIG. 15 illustrates a second isometric view of assembly with cowling, removed from hull, of the retractable bow thruster and trolling motor.
Figure 16:
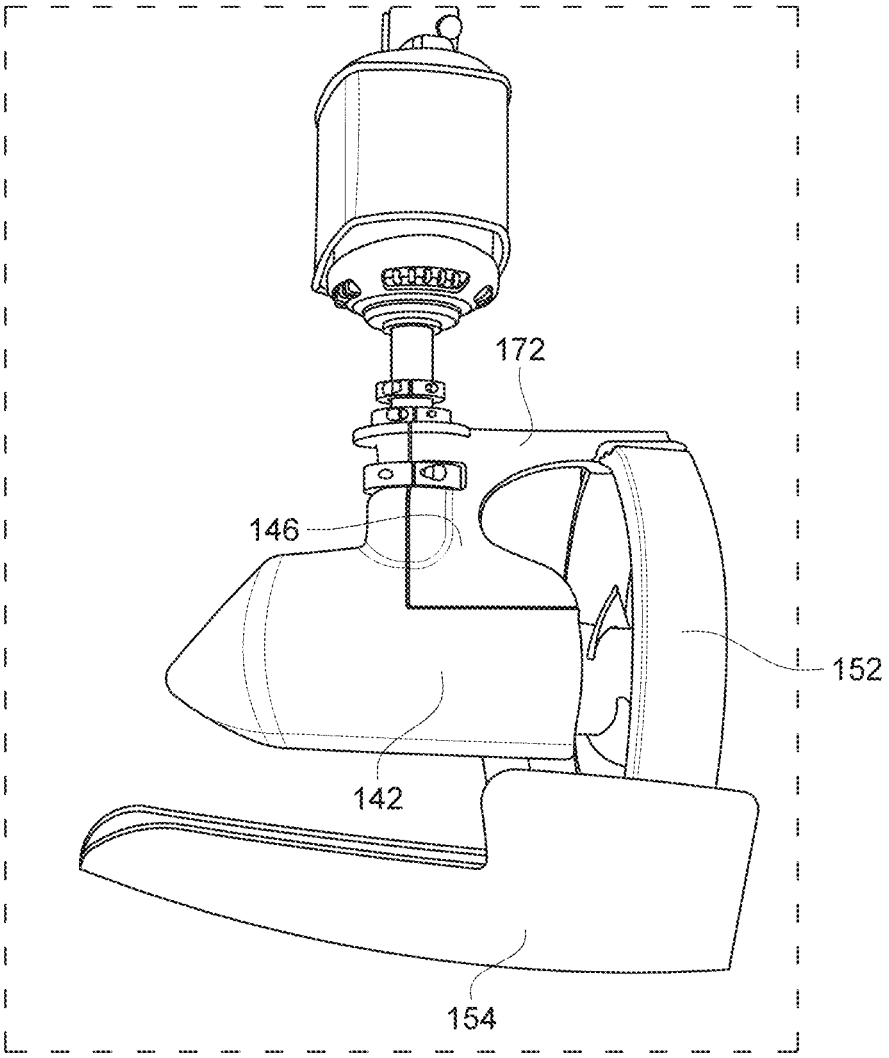
FIG. 16 illustrates a side view of assembly with cowling, removed from hull, of the retractable bow thruster and trolling motor.

Referring to FIGS. 15 and 16, a second isometric view and a side view of the bow thruster and trolling motor assembly with cowling, extended from the hull 204 of the retractable bow thruster and trolling motor is shown.

The cowling 154 is shown installed, braced against the prop casing lower support arm 172. Also shown are the motor housing 142, motor housing access hatch 146, prop casing 152, and collar clamp 148. Also, an optional mounting block 155 is shown at which location an optional camera or transducer (e.g., a depth finder) is mounted to the motor housing 142.

Referring to FIG. 16, an embodiment in which the bow thruster and trolling motor is shown having a distal trolling motor 342 for thrust located distal from the propeller 150. In this, the distal trolling motor 342 is mounted at the end of the shaft 314 and, rotational movement from the distal trolling motor 342 is transferred to the propeller through the shaft 314 by an internal shaft or flexible shaft (not shown for clarity and brevity reasons) and motion transfer gears (not shown for clarity and brevity reasons). Also shown in the example of FIG. 16 is a rotating motor 322 that electrically rotates the shaft 314, and hence the propeller 150 for steering, though in some embodiments, steering is performed by manually rotating the shaft 314. Also shown in the example of FIG. 16 is a piston/sleeve deployment mechanism 350 that moves the shaft linearly to deploy or retract the propeller 150. The propeller 150 and prop casing 152 (e.g., shroud) are shown retracted (flush with the exterior hull 204) by the piston/sleeve deployment mechanism 350 in solid lines and deployed in dashed lines.

Figure 17:
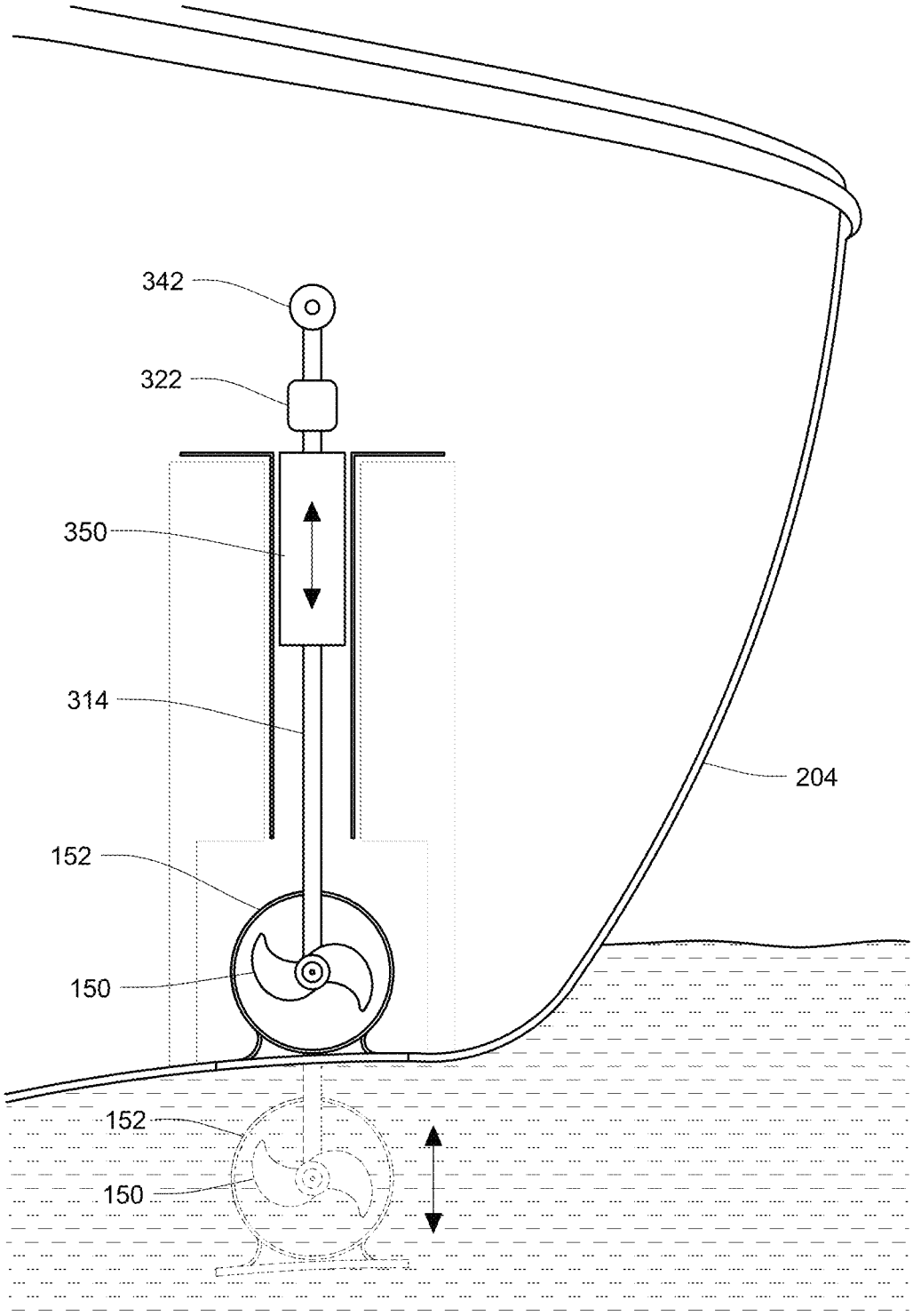
FIG. 17 illustrates an embodiment in which the bow thruster and trolling motor are shown in the retracted position, sealing the hull, and the extended position for providing thrust.

Referring to FIG. 17, an embodiment in which the bow thruster and trolling motor are shown in the retracted position, sealing the hull, and the extended position for providing thrust. The distal trolling motor 342 is shown as in FIG. 16, coupled to the propeller 150 through the shaft 314.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A retractable trolling motor system for a boat, comprising:

a. a recess within a hull of the boat, the hull having a forward end and an aft end;

a1. a primary water-diverting protrusion affixed on the hull of the boat at the recess closest to the forward end of the hull;

b. a trolling motor assembly having a trolling motor and propeller and configured to fit within the recess when not in use and to extend outwardly from the recess when in use; and c. a cowling attached to a bottom portion of the trolling motor assembly, wherein the cowling is shaped to seal against the recess when the trolling motor assembly is in a retracted position, the cowling having a secondary water-diverting protrusion on an edge that is positioned closest to the aft end of the hull.

2. The retractable trolling motor system of claim 1, wherein the trolling motor assembly is configured to rotate about a vertical axis to control a direction of thrust from the propeller when the trolling motor turns the propeller.

3. The retractable trolling motor system of claim 2, wherein the trolling motor assembly has a steering motor that is configured to rotate the trolling motor assemble about the vertical axis under electrical control.

4. The retractable trolling motor system of claim 1, wherein the trolling motor assembly is configured to extend and retract along a vertical axis.

5. The retractable trolling motor system of claim 1, further comprising a means for connecting a device selected from a group consisting of a camera and a sensor to the trolling motor assembly.

6. A retractable trolling motor system for a boat, comprising:

a. a recess within a hull of the boat, the hull having a forward end and an aft end;

a1. a primary water-diverting protrusion affixed on the hull of the boat at the recess closest to the forward end of the hull;

b. a trolling assembly affixed to a shaft and having a propeller and configured to fit within the recess when not in use and to extend outwardly from the recess when in use; and c. a cowling attached to an outside portion of the trolling assembly, wherein the cowling is shaped to seal against the recess when the trolling assembly is in a retracted position.

7. The retractable trolling motor system of claim 6, wherein a drive motor is rotatably interfaced to a first end of a second shaft, the second shaft housed within the shaft and the propeller is rotatably interfaced to a second end of the second shaft.

8. The retractable trolling motor system of claim 7, wherein the trolling assembly is configured to rotate about a vertical axis to control a direction of thrust from the propeller when the drive motor turns the propeller.

9. The retractable trolling motor system of claim 8, wherein the trolling assembly has a steering motor that is configured to rotate the trolling assembly about the vertical axis under electrical control.

10. The retractable trolling motor system of claim 8, wherein the trolling assembly is configured to extend and retract along the vertical axis.

11. A method of installing a retractable trolling motor to a boat, the method comprising:

a. cutting or forming an orifice in a surface of a hull of the boat; the hull having a forward end and an aft end;

a1. Affixing a primary water-diverting protrusion on the hull of the boat at an edge of the orifice that is closest to the forward end of the hull;

b. forming a cowling that is shaped to seal the orifice, the cowling having a secondary water-diverting protrusion on an aft edge that is positioned closest to the aft end of the hull;

c. providing a trolling motor and a propeller that are affixed to an end of a shaft, the trolling motor and the propeller configured to fit within the orifice when not in use and to extend outwardly from the orifice when in use, the cowling affixed to the trolling motor; and d. rotatably affixing the shaft to the boat such that to the cowling, the trolling motor, and the propeller rotate when rotating the shaft.

12. The method of claim 11, further comprising moving the trolling motor and the propeller between an extended position and a retracted position comprise moving the shaft along an axis of the shaft.

13. The method of claim 8, further comprising moving of the trolling motor and the propeller between an extended position and a retracted position is performed by a manual action.

14. The method of claim 8, further comprising moving of the trolling motor and the propeller between an extended position and a retracted position is performed by an actuator.

15. The retractable trolling motor system of claim 6, wherein the cowling has a secondary water-diverting protrusion on an edge that is positioned closest to the aft end of the hull.

* * * * *